US012221773B2

(12) United States Patent
Eguchi et al.

(10) Patent No.: US 12,221,773 B2
(45) Date of Patent: Feb. 11, 2025

(54) OBSTACLE NOTIFICATION SYSTEM FOR WORK MACHINE AND OBSTACLE NOTIFICATION METHOD FOR WORK MACHINE

(71) Applicant: Komatsu Ltd., Tokyo (JP)

(72) Inventors: Taro Eguchi, Tokyo (JP); Koichi Nakazawa, Tokyo (JP); Yoshiyuki Shitaya, Tokyo (JP); Takeshi Kurihara, Tokyo (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 18/024,080

(22) PCT Filed: Sep. 2, 2021

(86) PCT No.: PCT/JP2021/032281
§ 371 (c)(1),
(2) Date: Mar. 1, 2023

(87) PCT Pub. No.: WO2022/050347
PCT Pub. Date: Mar. 10, 2022

(65) Prior Publication Data

US 2023/0272600 A1 Aug. 31, 2023

(30) Foreign Application Priority Data

Sep. 2, 2020 (JP) ..... 2020-147856

(51) Int. Cl.
*E02F 9/26* (2006.01)
*E02F 9/24* (2006.01)

(52) U.S. Cl.
CPC . *E02F 9/26* (2013.01); *E02F 9/24* (2013.01)

(58) Field of Classification Search
CPC ..... E02F 9/26; E02F 9/24; E02F 3/435; E02F 9/261; B66C 23/94
See application file for complete search history.

(56) References Cited

U.S. PATENT DOCUMENTS

| | | | | |
|---|---|---|---|---|
| 10,496,271 | B2 * | 12/2019 | Smith | G06F 3/0485 |
| 2008/0136976 | A1 * | 6/2008 | Ajito | H04N 9/3185 348/745 |
| 2011/0228980 | A1 | 9/2011 | Ichikawa et al. | |
| 2012/0140072 | A1 | 6/2012 | Murashita et al. | |
| 2013/0088593 | A1 * | 4/2013 | Ishimoto | E02F 9/226 348/143 |
| 2013/0147958 | A1 * | 6/2013 | Mitsuta | H04N 23/90 348/148 |

(Continued)

FOREIGN PATENT DOCUMENTS

| | | | |
|---|---|---|---|
| EP | 3537403 | A1 | 9/2019 |
| JP | 2012-001995 | A | 1/2012 |

(Continued)

*Primary Examiner* — Ryan W Sherwin
(74) *Attorney, Agent, or Firm* — Fish & Richardson P.C.

(57) ABSTRACT

An obstacle determination unit determines whether or not an obstacle is within a detection range being a detection target of the obstacle. A notification unit gives notification indicating the obstacle when determined as the obstacle being present. An operation input unit receives an operation to the display unit for changing the detection range. A change unit changes the size of the detection range based on the operation.

12 Claims, 16 Drawing Sheets

(56) References Cited

U.S. PATENT DOCUMENTS

| | | | | |
|---|---|---|---|---|
| 2013/0182066 | A1* | 7/2013 | Ishimoto | E02F 9/261 348/38 |
| 2013/0222573 | A1* | 8/2013 | Onuma | E02F 9/24 348/82 |
| 2014/0118533 | A1* | 5/2014 | Chang | E02F 9/261 348/118 |
| 2017/0107693 | A1* | 4/2017 | Yamada | E02F 9/26 |
| 2018/0082420 | A1* | 3/2018 | Brown | G06T 7/0016 |
| 2018/0206392 | A1 | 7/2018 | Matsuzaki | |
| 2018/0274206 | A1* | 9/2018 | Kozui | E02F 9/123 |
| 2020/0384918 | A1 | 12/2020 | Eguchi et al. | |
| 2021/0303834 | A1* | 9/2021 | Ozaki | G06V 40/103 |
| 2022/0057802 | A1* | 2/2022 | Spielman, Jr. | E02F 9/0841 |
| 2022/0317842 | A1* | 10/2022 | Kumakura | E02F 9/261 |
| 2023/0304264 | A1* | 9/2023 | Noda | E02F 9/262 |

FOREIGN PATENT DOCUMENTS

| | | | |
|---|---|---|---|
| JP | 2012123470 | A | 6/2012 |
| JP | 5143235 | B | 2/2013 |
| JP | 2014-062387 | A | 4/2014 |
| JP | 2016035791 | A | 3/2016 |
| JP | 2018113937 | A | 7/2018 |
| JP | 2018-123646 | A | 8/2018 |
| JP | 2019151142 | A | 9/2019 |
| JP | 2020-057113 | A | 4/2020 |
| WO | 2018084161 | A1 | 5/2018 |

* cited by examiner

OBSTACLE NOTIFICATION SYSTEM FOR WORK MACHINE AND OBSTACLE NOTIFICATION METHOD FOR WORK MACHINE

CROSS-REFERENCE TO RELATED APPLICATIONS

This application is a National Stage application under 35 U.S.C. § 371 of International Application No. PCT/JP2021/032281, filed on Sep. 2, 2021, which claims priority to Japanese Patent Application No. 2020-147856, filed on Sep. 2, 2020. The contents of the prior applications are incorporated herein in their entirety.

TECHNICAL FIELD

The present disclosure relates to an obstacle notification system for a work machine and an obstacle notification method for the work machine.

BACKGROUND ART

Patent Document 1 discloses a technique related to a periphery monitoring system that detects people in the vicinity of a work machine. According to the technique described in Patent Document 1, the periphery monitoring system detects surrounding obstacles.

CITATION LIST

Patent Literature

Patent Document 1 Japanese Unexamined Patent Application Publication No. 2016-035791

DISCLOSURE OF INVENTION

Technical Problem

When detecting an obstacle, the periphery monitoring system notifies the presence of the obstacle from a display, a speaker, or the like. The operator of the work machine receives the information from the vicinity monitoring system, confirms that there are obstacles, and confirms that safety is ensured.

Depending on the work contents of the work machine, monitoring of obstacles over the entire circumference of the work machine may not be necessary. For example, in the loading swing operation to the dump truck, there is a possibility that the detection of an obstacle is unnecessary in the direction in which the dump truck exists.

An object of the present disclosure is to provide an obstacle notification system for a work machine and an obstacle notification method for a work machine in which the detection range of an obstacle in the work machine can be changed.

Means for Solving the Problem

According to an aspect of the present invention, an obstacle notification system for a work machine comprises: an obstacle determination unit that is configured to determine whether or not an obstacle is within a detection range being a detection target of the obstacle; a notification unit that is configured to give notification indicating the obstacle when determined as the obstacle being present; an operation input unit that is configured to receive an operation to a display unit for changing the detection range; and a change unit that is configured to change the size of the detection range based on the operation.

Advantageous Effects of Invention

According to the above aspect, an operator of the work machine can change the detection range of an obstacle for the work machine.

MODE FOR CARRYING OUT THE INVENTION

First Embodiment

The embodiment will be described in detail below with reference to the drawings.

<<Configuration of Work Machine 100>>

Figure 1:
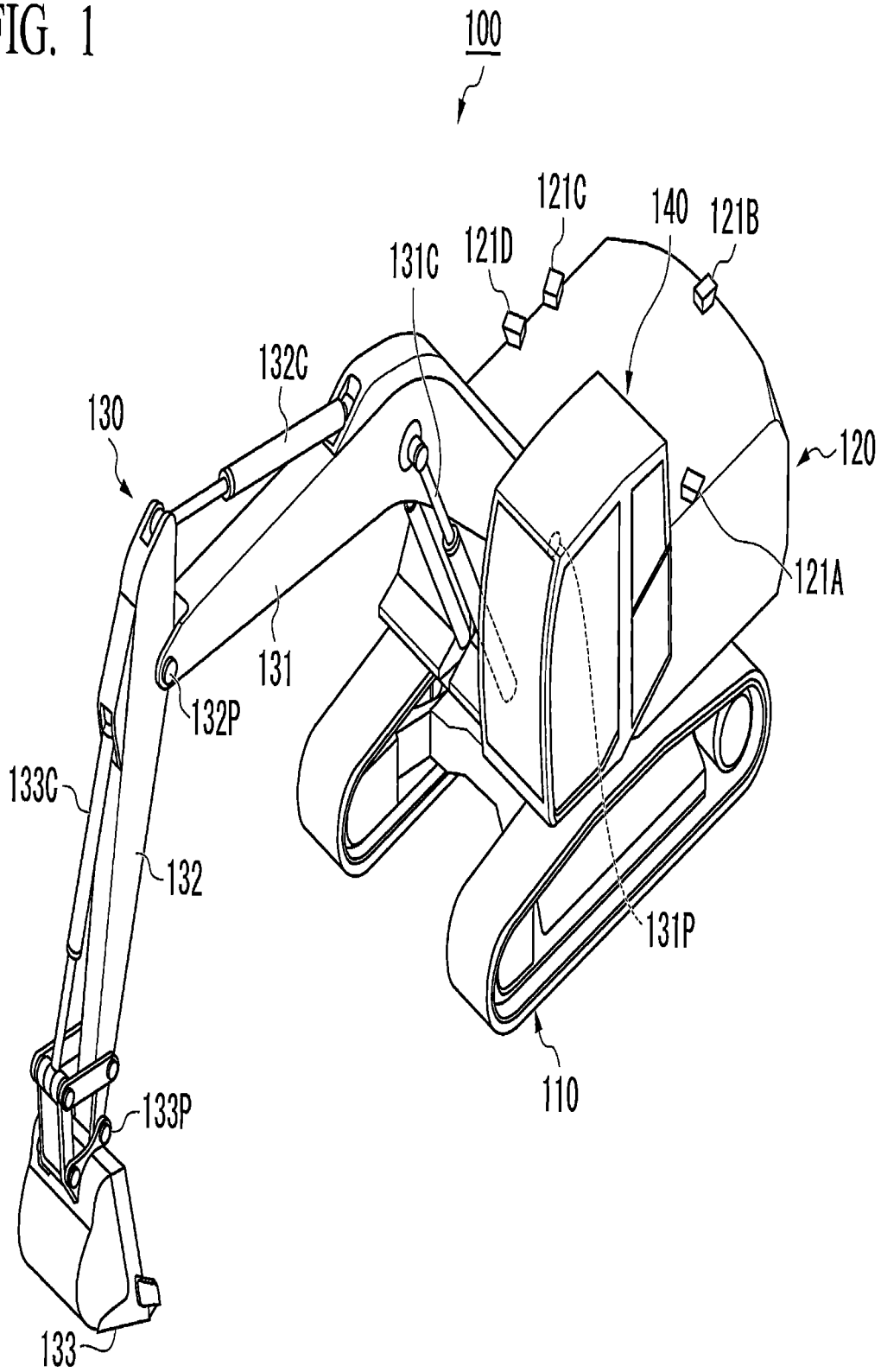
FIG. 1 is a schematic diagram showing a configuration of a work machine according to a first embodiment.

FIG. 1 is a schematic diagram illustrating the configuration of a work machine 100 according to a first embodiment.

The work machine 100 operates at a construction site and constructs a construction target such as earth. A work machine 100 according to the first embodiment is, for example, a hydraulic excavator. The work machine 100 includes an undercarriage 110, swing body 120, work equipment 130 and a cab 140.

The undercarriage 110 supports the work machine 100 so as to be capable of traveling. The undercarriage 110 is, for example, a pair of right and left endless tracks.

The swing body 120 is supported by the undercarriage 110 so as to be capable of swinging around the swing center.

The work equipment 130 is driven by hydraulic pressure. The work equipment 130 is supported on a front portion of swing body 120 so as to be capable of driving in an up-down direction. The cab 140 is a space for an operator gets on and for performing operations of the work machine 100. The cab 140 is provided in a front left portion of the swing body 120.

Here, a portion of the swing body 120 to which the work equipment 130 is attached is called the front portion. In addition, with respect to the swing body 120, an opposite portion of the front portion is referred to as the rear portion, the left-side portion on the basis of the front portion is referred to as the left portion, and the right-side portion on the basis of the front portion is referred to as the right portion.

<<Configuration of Swing Body 120>>

Figure 2:
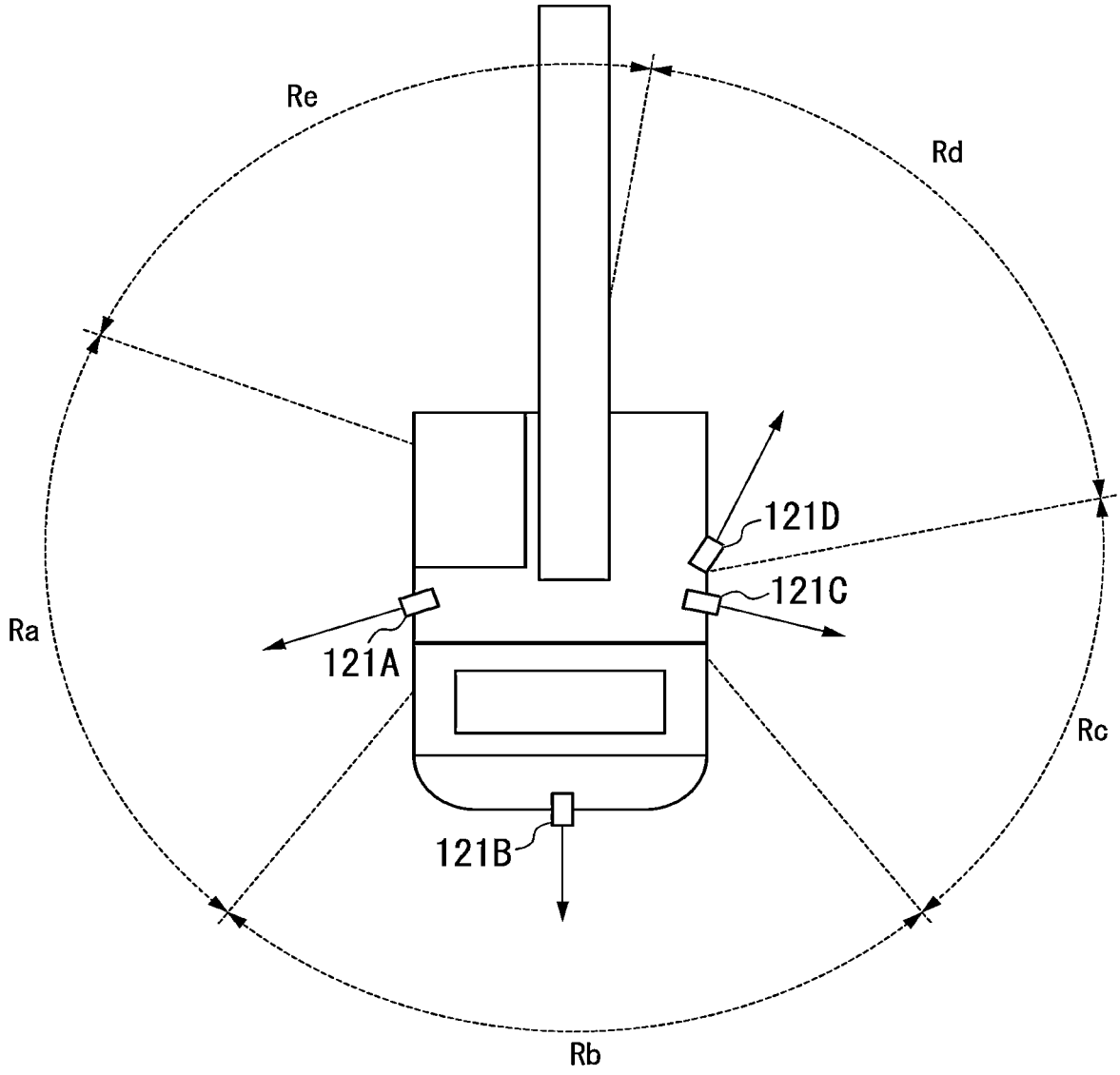
FIG. 2 is a diagram illustrating imaging ranges of a plurality of cameras 121 included in the work machine according to the first embodiment.

A plurality of cameras 121 for imaging around the work machine 100 are provided on the swing body 120. FIG. 2 is a diagram illustrating imaging ranges of the plurality of cameras 121 included in the work machine 100 according to the first embodiment.

Specifically, the swing body 120 includes a left rear camera 121A that captures an image of a left rear region Ra from around the swing body 120, a rear camera 121B that captures an image of a rear region Rb from around the swing body 120, a right rear camera 121C that captures an image of a right rear region Rc from around the swing body 120, and a right front camera 121D that captures an image of a right front region Rd from around the swing body 120. Part of the imaging ranges of the plurality of cameras 121 may overlap each other.

The imaging range of the plurality of cameras 121 covers the entire periphery of the work machine 100, excluding the left front region Re which is visible from the cab 140. In addition, although the cameras 121 according to the first embodiment image the left rear, rear, right rear, and right front of the swing body 120, other embodiments are not limited to this. For example, the number and imaging ranges of cameras 121 according to another embodiment may differ from the examples shown in FIG. 1 and FIG. 2.

The left rear camera 121A captures the range of the left side region and the left rear region of the swing body 120, as shown in the left rear region Ra in FIG. 2; however, it may capture one of these regions. Similarly, the right rear camera 121C captures the range of the right-side region and the right rear region of the swing body 120 as shown in the right rear region Rc in FIG. 2; however, it may capture one of these regions. Similarly, the right front camera 121D captures a range of the right front region and the right-side region of the swing body 120 as shown in the right front region Rd in FIG. 2; however, it may capture one of these regions. Further, in another embodiment, a plurality of cameras 121 may be used so as to set the entire periphery of the work machine 100 as the imaging range. For example, a left front camera that captures the left front region Re may be provided, and the entire periphery of the work machine 100 may be the imaging range.

<<Configuration of Work Equipment 130>>

The work equipment 130 includes a boom 131, an arm 132, a bucket 133, a boom cylinder 131C, an arm cylinder 132C, and a bucket cylinder 133C.

A base end portion of the boom 131 is attached to the swing body 120 via a boom pin 131P.

The arm 132 connects the boom 131 and the bucket 133. A base end portion of the arm 132 is attached to a tip end portion of the boom 131 via an arm pin 132P.

The bucket 133 has a blade for excavating earth, and a container for containing the excavated earth. A base end portion of the bucket 133 is attached to a tip end portion of the arm 132 via a bucket pin 133P.

The boom cylinder 131C is a hydraulic cylinder for operating the boom 131. A base end portion of the boom cylinder 131C is attached to the swing body 120. A tip end portion of the boom cylinder 131C is attached to the boom 131.

The arm cylinder 132C is a hydraulic cylinder for driving the arm 132. A base end portion of the arm cylinder 132C is attached to the boom 131. A tip end portion of the arm cylinder 132C is attached to the arm 132.

The bucket cylinder 133C is a hydraulic cylinder for driving the bucket 133. A base end portion of the bucket cylinder 133C is attached to the arm 132. A tip end portion of the bucket cylinder 133C is attached to a link member connected to the bucket 133.

<<Configuration of Cab 140>>

Figure 3:
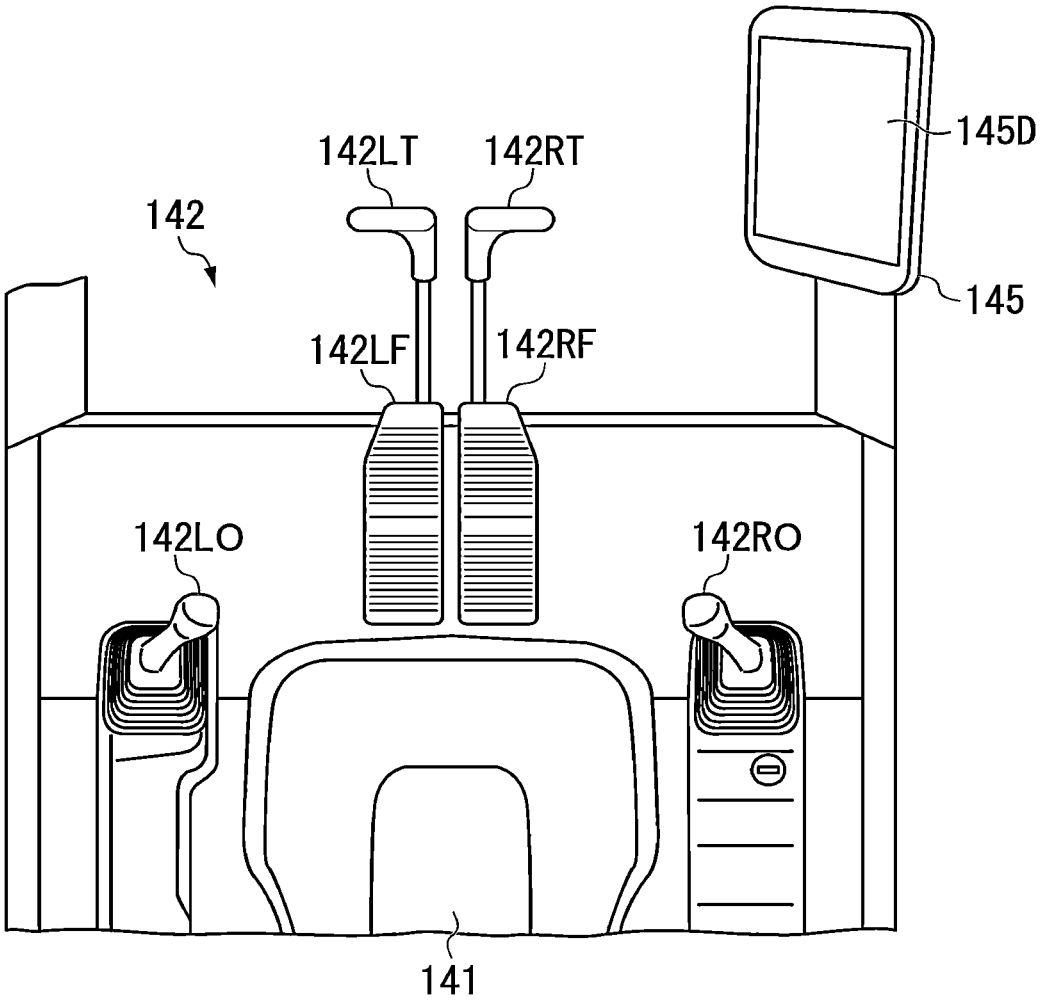
FIG. 3 is a diagram illustrating an internal configuration of a cab according to a first embodiment.

FIG. 3 is a diagram illustrating the internal configuration of the cab 140 according to the first embodiment.

An operator's seat 141, an operation device 142 and a control device 145 are provided in the cab 140.

The operation device 142 is a device for driving the undercarriage 110, the swing body 120, and the work equipment 130 by manual operation by the operator. The operation device 142 includes a left operation lever 142LO, a right operation lever 142RO, a left foot pedal 142LF, a right foot pedal 142RF, a left travel lever 142LT, and a right travel lever 142RT.

The left operation lever 142LO is provided on a left side of the operator's seat 141. The right operating lever 142RO is provided on a right side of the operator's seat 141.

The left operation lever 142LO is an operation mechanism for a swing motion of the swing body 120 and excavating and dumping motions of the arm 132. Specifically, when the operator of work machine 100 tilts the left operation lever 142LO forward, the arm 132 performs a dumping motion. Further, when the operator of work machine 100 tilts left operation lever 142LO rearward, the arm 132 performs an excavating motion. Further, when the operator of work machine 100 tilts the left operation lever 142LO rightward, the swing body 120 swings rightward. Further, when the operator of the work machine 100 tilts the left operation lever 142LO leftward, the swing body 120 swings leftward. In addition, another embodiment may perform swinging rightward or leftward of the swing body 120 when the left operation lever 142LO is tilted in a front-rear direction and perform the excavating motion or the dumping motion of the arm 132 when the left operation lever 142LO is tilted in a left-right direction.

The right operation lever 142RO is an operation mechanism for performing excavation and dumping motions of the bucket 133 and raising and lowering motions of the boom 131. Specifically, when the operator of the work machine 100 tilts the right operation lever 142RO forward, the lowering motion of the boom 131 is performed. Further, when the operator of the work machine 100 tilts the right operation lever 142RO rearward, the raising motion of the boom 131 is performed. Further, when the operator of the work machine 100 tilts the right operation lever 142RO rightward, the dumping motion of the bucket 133 is performed. Further, when the operator of the work machine 100 tilts the right operation lever 142RO leftward, the excavation motion of the bucket 133 is performed. In addition, another embodiment may perform the dumping motion or the excavating motion of the bucket 133 when the right operation lever 142RO is tilted in the front-rear direction, and perform the raising motion or the lowering motion of the boom 131 when the right operation lever 142RO is tilted in the left-right direction.

The left foot pedal 142LF is disposed on a left side of a floor in front of the operator's seat 141. The right foot pedal 142 RF is disposed on a right side of the floor in front of the operator's seat 141. The left travel lever 142LT is pivotally supported by the left foot pedal 142LF and configured so that the tilting of the left travel lever 142LT and pressing down of the left foot pedal 142LF are linked together. The right travel lever 142RT is pivotally supported by the right foot pedal 142RF and configured so that the tilting of the right travel lever 142RT and pressing down of the right foot pedal 142RF are linked together.

The left foot pedal 142LF and the left travel lever 142LT correspond to rotational driving of the left crawler belt of the undercarriage 110. Specifically, when the operator of the work machine 100 tilts the left foot pedal 142LF or the left travel lever 142LT forward, the left crawler belt rotates in a forward movement direction. Further, when the operator of the work machine 100 tilts the left foot pedal 142LF or the left travel lever 142LT rearward, the left crawler belt rotates in a rearward movement direction.

The right foot pedal 142RF and the right travel lever 142RT correspond to rotational driving of the right crawler belt of the undercarriage 110. Specifically, when the operator of the work machine 100 tilts the right foot pedal 142RF or the right travel lever 142RT forward, the right crawler belt rotates in the forward movement direction. Further, when the operator of the work machine 100 tilts the right foot pedal 142RF or the right travel lever 142RT rearward, the right crawler belt rotates in the rearward movement direction.

The control device 145 includes a display 145D that displays information related to multiple functions of the work machine 100. The control device 145 is an example of a display system. Also, the display 145D is an example of a display unit. An input means of the control device 145 according to the first embodiment is a touch panel.

<<Configuration of Control Device 145>>

Figure 4:
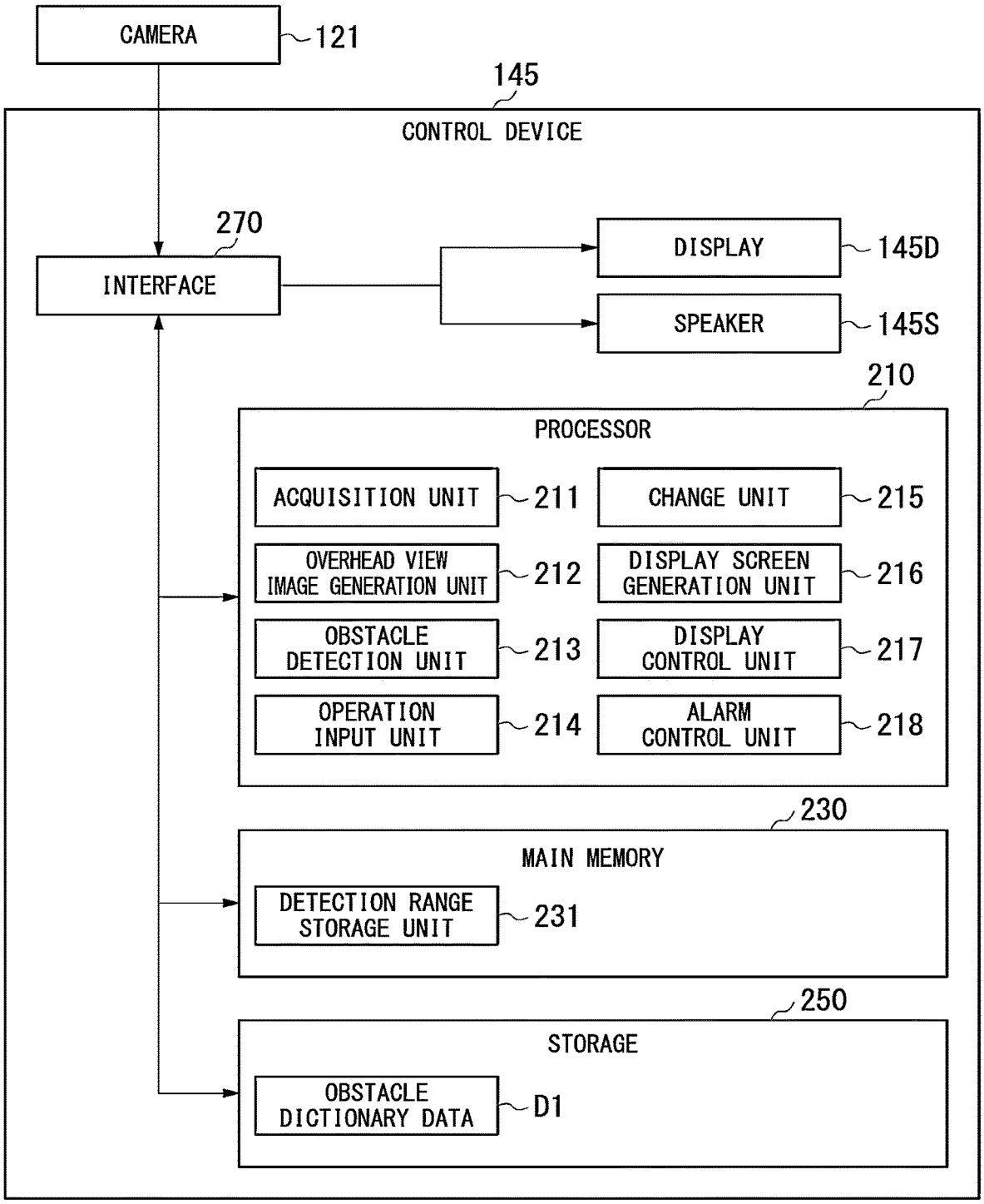
FIG. 4 is a schematic block diagram illustrating a configuration of a control device according to the first embodiment.

FIG. 4 is a schematic block diagram illustrating the configuration of the control device 145 according to the first embodiment.

The control device 145 is a computer including a processor 210, a main memory 230, a storage 250, and an interface 270. In addition, the control device 145 includes the display 145D and a speaker 145S. In addition, the control device 145 according to the first embodiment is provided integrally with the display 145D and the speaker 145S, but in another embodiment, at least one of the display 145D and the speaker 145S may be provided discretely from the control device 145. In addition, when the display 145D and the control device 145 are discretely provided, the display 145D may be provided outside the cab 140. In this case, the display 145D may be a mobile display. Further, when the work machine 100 is driven by remote operation, the display 145D may be provided in a remote operation room provided remotely from the work machine 100. Similarly, when the speaker 145S and the control device 145 are discretely provided, the speaker 145S may be provided outside the cab 140. In addition, when the work machine 100 is driven by remote operation, the speaker 145S may be provided in a remote operation room provided remotely from the work machine 100.

Incidentally, the control device 145 may be configured by a single computer, or the configuration of the control device 145 may be divided into a plurality of computers to be disposed, such that the plurality of computers may cooperate with each other to function as an obstacle notification system for a work machine. The work machine 100 may include a plurality of computers that function as the control device 145. A portion of the computers constituting the control device 145 may be mounted inside the work machine 100, and other computers may be provided outside the work machine 100.

In addition, the above-mentioned one control device 145 is also one example of the obstacle notification system for a work machine. In another embodiment, a portion of the configurations constituting the obstacle notification system for a work machine may be mounted inside the work machine 100, and other configurations may be provided outside the work machine 100. For example, the obstacle notification system for a work machine may be configured such that the display 145D is provided in a remote operation room provided remotely from the work machine 100. In yet another embodiment, one or a plurality of computers constituting the obstacle notification system for a work machine may all be provided outside the work machine 100.

The camera 121, the display 145D, and speaker 145S are connected to the processor 210 via the interface 270.

Exemplary examples of the storage 250 include an optical disk, a magnetic disk, a magneto-optical disk, a semiconductor memory, or the like. The storage 250 may be an internal medium that is directly connected to a bus of the control device 145 or may be an external medium connected to the control device 145 via the interface 270 or a communication line. The storage 250 stores a program for realizing the periphery monitoring of the work machine 100. In addition, the storage 250 stores in advance a plurality of images including an icon for displaying on the display 145D.

The program may realize some of functions to be exhibited by the control device 145. For example, the program may exhibit functions in combination with another program that is already stored in the storage 250 or in combination with another program installed in another device. Incidentally, in another embodiment, the control device 145 may include a custom large scale integrated circuit (LSI) such as a programmable logic device (PLD) in addition to the above configuration or instead of the above configuration. Exemplary examples of the PLD include a programmable array logic (PAL), a generic array logic (GAL), a complex programmable logic device (CPLD), and a field programmable gate array (FPGA). In this case, some or all of the functions to be realized by the processor 210 may be realized by the integrated circuit.

In addition, the storage 250 stores an obstacle dictionary data D1 for detecting an obstacle.

The obstacle dictionary data D1 may be, for example, dictionary data of a feature amount extracted from each of a plurality of known images in which an obstacle is captured. Exemplary examples of the feature amount include histograms of oriented gradients (HOG), co-occurrence hog (CoHOG), or the like.

By executing a program, the processor 210 includes an acquisition unit 211, an overhead view image generation unit 212, an obstacle detection unit 213, an operation input unit 214, a change unit 215, a display screen generation unit 216, a display control unit 217, and an alarm control unit 218. Further, the processor 210 secures a storage area for a detection range storage unit 231 in a main memory 230 by executing the program.

The detection range storage unit 231 stores a detection range that is a detection target of obstacles by the obstacle detection unit 213. The detection range storage unit 231 according to the first embodiment stores any one of the left rear region Ra, the rear region Rb, the right rear region Rc, and the right front region Rd as the detection range.

The acquisition unit 211 acquires captured images from the plurality of cameras 121.

The overhead view image generation unit 212 deforms and combines a plurality of the captured images acquired by the acquisition unit 211 to generate an overhead view image in which the work machine 100 is centered when a site is viewed from above. Hereinafter, the captured image deformed by the overhead view image generation unit 212 is also referred to as a deformed image. The overhead view image generation unit 212 may cut out a portion of each of the deformed captured images and combine the cutout captured images to generate an overhead view image. An image of the work machine 100 viewed from above is attached in advance to the center of the overhead view image generated by the overhead view image generation unit 212. That is, the overhead view image is a periphery image in which the periphery of the work machine 100 is captured.

The obstacle detection unit 213 detects an obstacle in an image in which the detection range stored in the detection range storage unit 231 is shown among the captured images acquired by the acquisition unit 211. That is, the obstacle detection unit 213 is one example of an obstacle determination unit that determines whether or not an obstacle is in the periphery of the work machine 100. Exemplary examples of an obstacle include a person, a vehicle, a rock, or the like. In addition, the obstacle detection unit 213 according to another embodiment may detect obstacles in each captured image and mask obstacles that are not included in the detection range stored in the detection range storage unit 231.

The obstacle detection unit 213 detects an obstacle by, for example, the following procedure. The obstacle detection unit 213 extracts the feature amount from each captured image acquired by the acquisition unit 211. The obstacle detection unit 213 detects an obstacle from the captured image based on the extracted feature amount and the obstacle dictionary data. Exemplary examples of an obstacle detection method include pattern matching, object detection processing based on machine learning, or the like.

In addition, in the first embodiment, the obstacle detection unit 213 detects a person by using the feature amount of the image but is not limited thereto. For example, in another embodiment, the obstacle detection unit 213 may detect an obstacle based on a measured value of light detection and ranging (LiDAR), or the like.

The operation input unit 214 receives an input from an operator's touch operation to the touch panel of the control device 145. In particular, operation input unit 214 receives a swipe operation on the touch panel as an operation to change the detection range on display 145D. The swipe operation is an operation of sliding a finger touching the touch panel. The operation input unit 214 identifies start coordinates and end coordinates for a swipe operation on the touch panel. In addition, in the present embodiment, the swipe operation will be described as including a flick operation.

The change unit 215 rewrites the detection range stored in the detection range storage unit 231 based on the input to the operation input unit 214.

The display screen generation unit 216 generates a display screen data G1 in which a marker G12 indicating the position of an obstacle is disposed at the position corresponding to the detected position of the obstacle by being superimposed on an overhead view image G11 generated by the overhead view image generation unit 212. The disposition of the marker G12 on the display screen data G1 is one example of the notification of the presence of the obstacle. Further, the display screen generation unit 216 disposes a frame line G13 representing the detection range stored in the detection range storage unit 231 in the display screen data G1. An example of the display screen will be described later. In addition, the frame line G13 may not be displayed in another embodiment.

The display control unit 217 outputs the display screen data G1 generated by the display screen generation unit 216 to the display 145D. As a result, the display 145D displays the display screen data G1. The display control unit 217 is one example of a notification unit.

The alarm control unit 218 outputs an alarm sound signal to the speaker 145S when the obstacle detection unit 213 detects an obstacle. The alarm control unit 218 is one example of the notification unit.

<<About Display Screen>>

Figure 5:
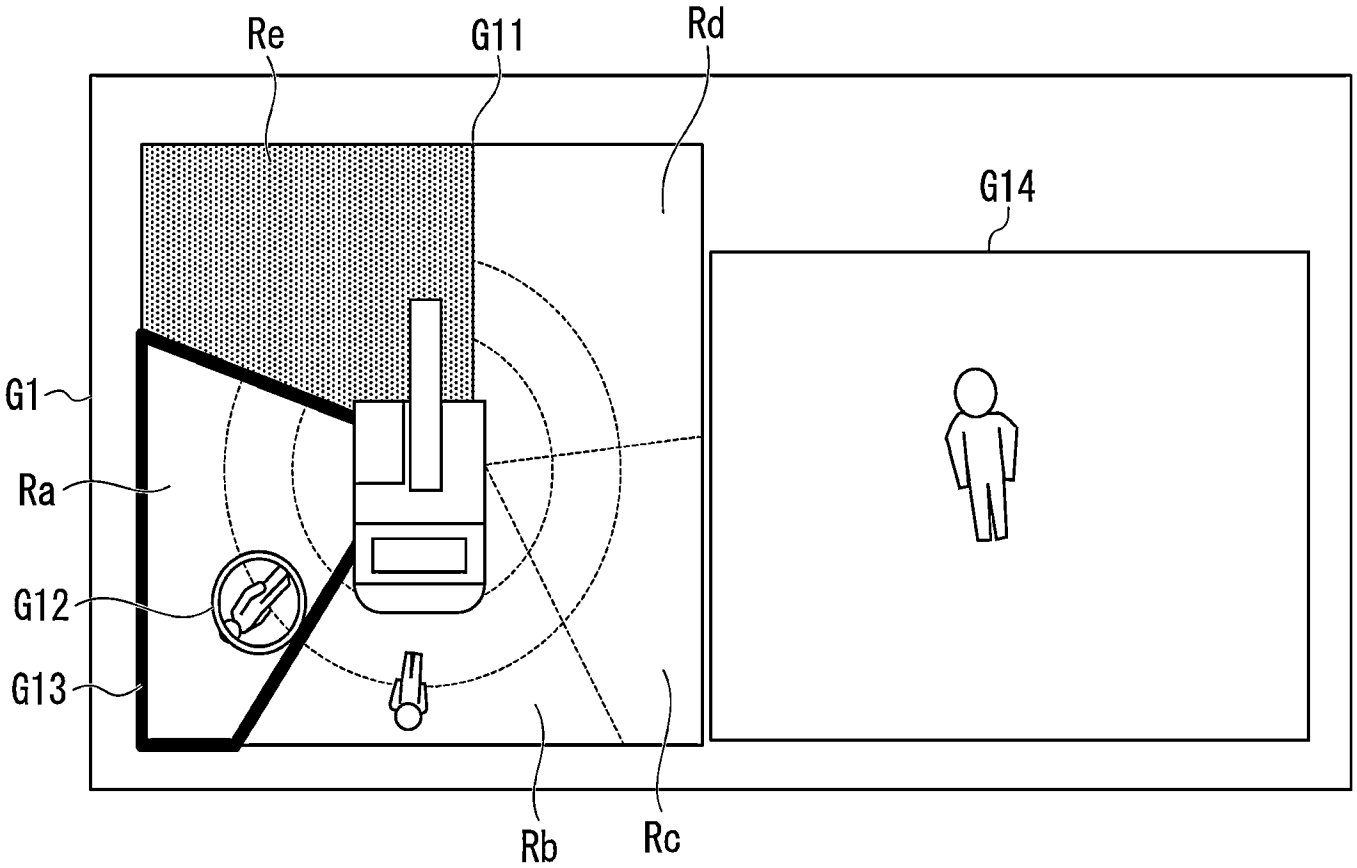
FIG. 5 is a diagram illustrating an example of a display screen according to the first embodiment.

FIG. 5 is a diagram illustrating an example of a display screen according to the first embodiment.

As shown in FIG. 5, the display screen data G1 includes the overhead view image G11, the marker G12, the frame line G13, and a single camera image G14.

The overhead view image G11 is an image of the site viewed from above. The overhead view image G11 has the left rear region Ra in which a deformed image according to the left rear camera 121A is shown, the rear region Rb in which a deformed image according to the rear camera 121B is shown, the right rear region Rc in which a deformed image according to the right rear camera 121C is shown, the right front region Rd in which a deformed image according to the right front camera 121D is shown, and the left front region Re in which an image is not shown. Incidentally, the boundary lines of the regions of the left rear region Ra, the rear region Rb, the right rear region Rc, the right front region Rd, and the left front region Re are not displayed in the overhead view image G11.

The marker G12 indicates the position of an obstacle. The shape of the marker G12 includes, for example, a circle, an ellipse, a regular polygon, and a polygon.

The frame line G13 surrounds a detection range among the left rear region Ra, the rear region Rb, the right rear region Rc, and the right front region Rd.

The single camera image G14 is a single camera image captured by one camera 121.

<<Notification Method of Obstacle>>

Figure 6:
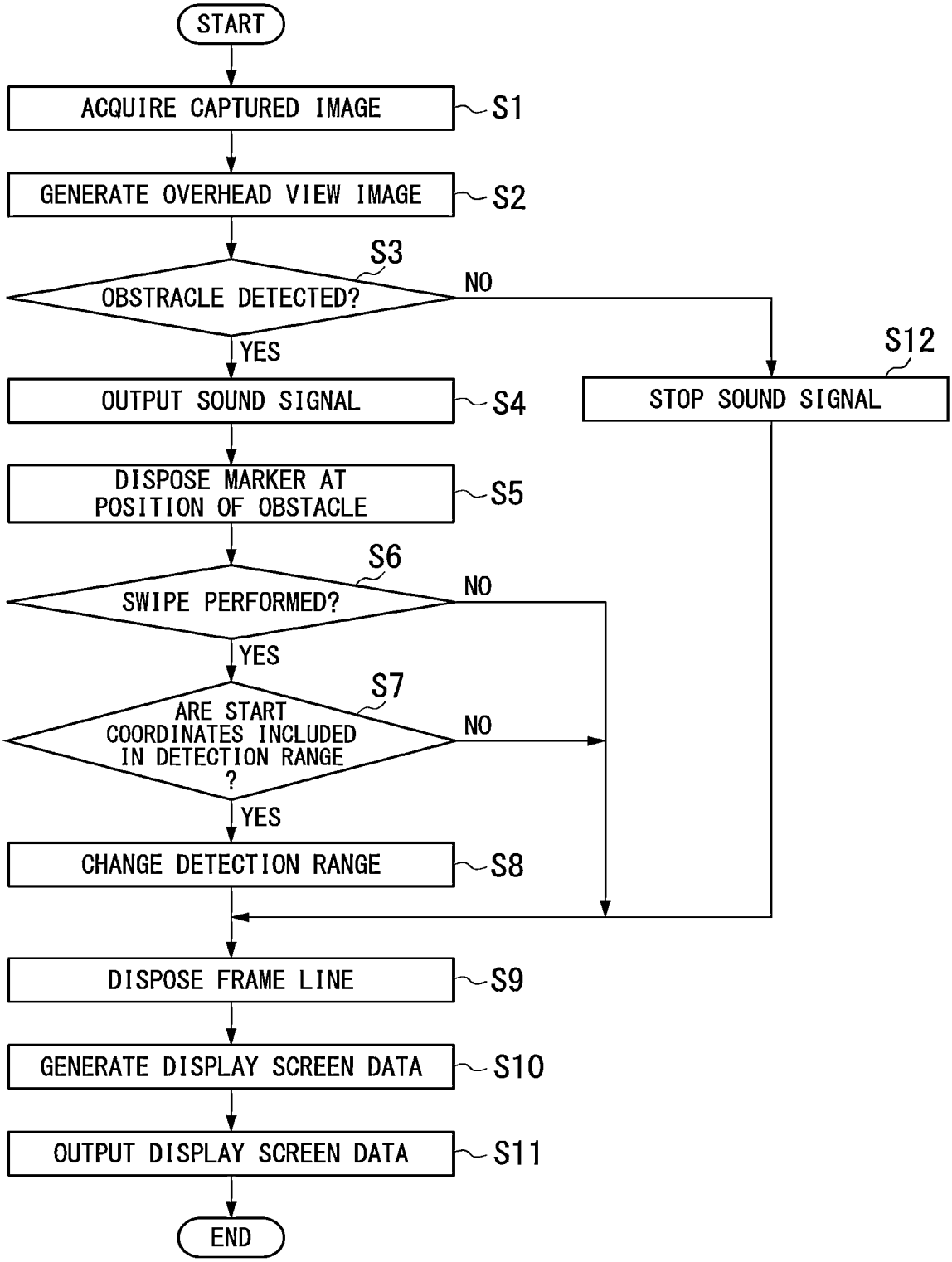
FIG. 6 is a flowchart illustrating an operation of the control device according to the first embodiment.

FIG. 6 is a flowchart illustrating an operation of the control device 145 according to the first embodiment.

When the control device 145 starts periphery monitoring processing, the acquisition unit 211 acquires captured images from the plurality of cameras 121 (step S1).

Next, the overhead view image generation unit 212 deforms and combines a plurality of the captured images acquired in the step S1 to generate the overhead view image G11 in which the work machine 100 is centered when a site is planarly viewed from above (step S2). Next, the obstacle detection unit 213 performs obstacle detection processing on an image related to the detection range stored in the detection range storage unit 231 among the captured images acquired in step S1, to determine whether an obstacle is detected (step S3). For example, when the detection range is the left rear region Ra, the obstacle detection unit 213 performs obstacle detection processing on the captured image captured by the left rear camera 121A.

When an obstacle is detected in the captured image (step S3: YES), the alarm control unit 218 outputs an alarm sound signal to the speaker 145S (step S4). Further, the display screen generation unit 216 disposes a marker G12 at a position corresponding to the detected obstacle in the overhead view image G11 generated in step S2 (step S5).

The operation input unit 214 determines whether or not the swipe operation has been performed on the touch panel (step S6). When the swipe operation has been performed (step S6: YES), the change unit 215 determines whether or not the start coordinates of the swipe operation are included in the detection range stored in the detection range storage unit 231 (step S7). When the start coordinates are not included in the detection range (step S7: NO), the change unit 215 treats the operation as not being a change operation.

When the start coordinates are included in the detection range (step S7: YES), the change unit 215 changes the detection range based on the start coordinates and the end coordinates of the swipe operation, and rewrites the detection range stored in the detection range storage unit 231 (step S8). For example, when the end coordinates of the swipe operation are located in a region other than the detection range among the left rear region Ra, rear region Rb, right rear region Rc, and right front region Rd, the operation input unit 214 sets said region as the detection range and cancels the detection range before change. Further, for example, when the end coordinates of the swipe operation remain within the detection range, the operation input unit 214 may set a region located in a direction of the swipe operation among the left rear region Ra, rear region Rb, right rear region Rc, and right front region Rd as the detection range and cancel the detection range before change.

When a target range is changed in step S8, or when the swipe operation is not performed in step S6 (step S7: NO), or when the start coordinates of the swipe operation are outside the target range (step S7: NO), the display screen generation unit 216 disposes the frame line G13 surrounding the detection range stored in the detection range storage unit 231 on the overhead view image G11 (step S9). Then, the display screen generation unit 216 generates display screen data G1 arranging the overhead view image G11 generated in step S2, the marker G12 disposed in step S5, the frame line G13 disposed in step S9, and the single camera image G14 acquired in step S1 (step S10). The display control unit 217 outputs the generated display screen data G1 to the display 145D (step S11).

When no obstacle is detected in the captured image in step S3 (step S3: NO), the alarm control unit 218 stops outputting the sound signal (step S12). Then, the display screen generation unit 216 disposes the frame line G13 surrounding the detection range stored in the detection range storage unit 231 on the overhead view image G11 (step S9), and generates display screen data G1 (step S10). The display control unit 217 outputs the generated display screen data G1 to the display 145D (step S11).

By repeatedly executing the above processing, the control device 145 can change the detection range for obstacle detection according to the change operation by the operator and detect the obstacle in the changed detection range.

In addition, the flowchart illustrated in FIG. 6 is an example, and not all steps need to be executed in another embodiment. For example, in another embodiment, the processing of steps S4 and S12 may not be executed when giving notification by an alarm is not performed. Further, for example, in yet another embodiment, the processing of step S5 may not be executed when giving notification by the marker G12 is not performed.

<<Operation Example>>

Hereinafter, an operation example of the control device 145 according to the first embodiment will be described with reference to the drawings.

Figure 7:
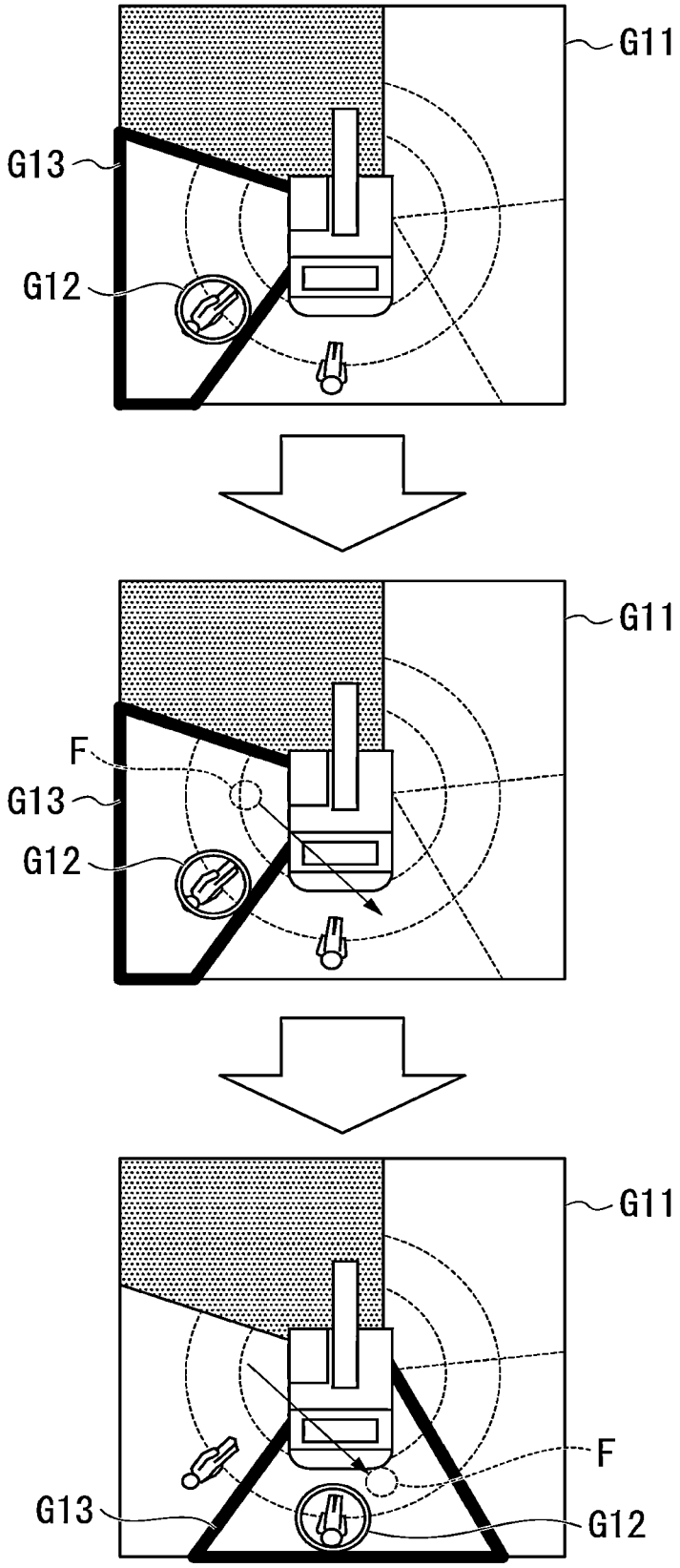
FIG. 7 is a diagram illustrating an operation example of the control device according to the first embodiment.

FIG. 7 is a diagram illustrating an operation example of the control device 145 according to the first embodiment.

The detection range storage unit 231 of the control device 145 stores the left rear region Ra as the detection range. In this case, the obstacle detection unit 213 determines the presence or absence of an obstacle in the left rear region Ra in step S3. When an obstacle is detected in the left rear region Ra, the display screen generation unit 216 disposes the marker G12 at a position corresponding to the detected position of the obstacle. The operator recognizes the presence of the obstacle in the left rear region Ra from the alarm made from the speaker 145S or the marker G12 displayed on the display 145D.

Here, in order to change the detection range of obstacle detection, the operator touches the left rear region Ra of the display 145D and performs the swipe operation toward the rear region Rb. When specifying that the start coordinates of the swipe operation are within a current detection range and the end coordinates are in the rear region Rb, the change unit 215 rewrites the detection range stored in the detection range storage unit 231 to the rear region Rb. As a result, a disposing position of the frame line G13 is switched from the left rear region Ra to the rear region Rb.

After that, the obstacle detection unit 213 determines the presence or absence of an obstacle in the rear region Rb in step S3. When an obstacle is detected in the rear region Rb, the display screen generation unit 216 disposes the marker G12 at a position corresponding to the detected position of the obstacle. The operator hears the alarm made from the speaker 145S and visually recognizes the display 145D to recognize the presence of the obstacle in the rear region Rb.

<<Operation and Effects>>

The control device 145 according to the first embodiment can change the direction of the detection range for obstacle detection by the swipe operation of the operator. Changing the direction of the detection range is an example of changing a size of the detection range. As a result, the operator can prevent the notification of the obstacle in the range where the detection of the obstacle is unnecessary depending on the work content or the like.

Further, the control device 145 according to the first embodiment identifies the changed detection range based on the swipe operation. As a result, the operator can change the detection range through an intuitive operation. Further, the control device 145 can prevent an occurrence of changing of the detection range due to an erroneous operation by determining whether or not the start coordinates of the swipe operation are within the detection range.

<<Modification Example>>

Figure 8:
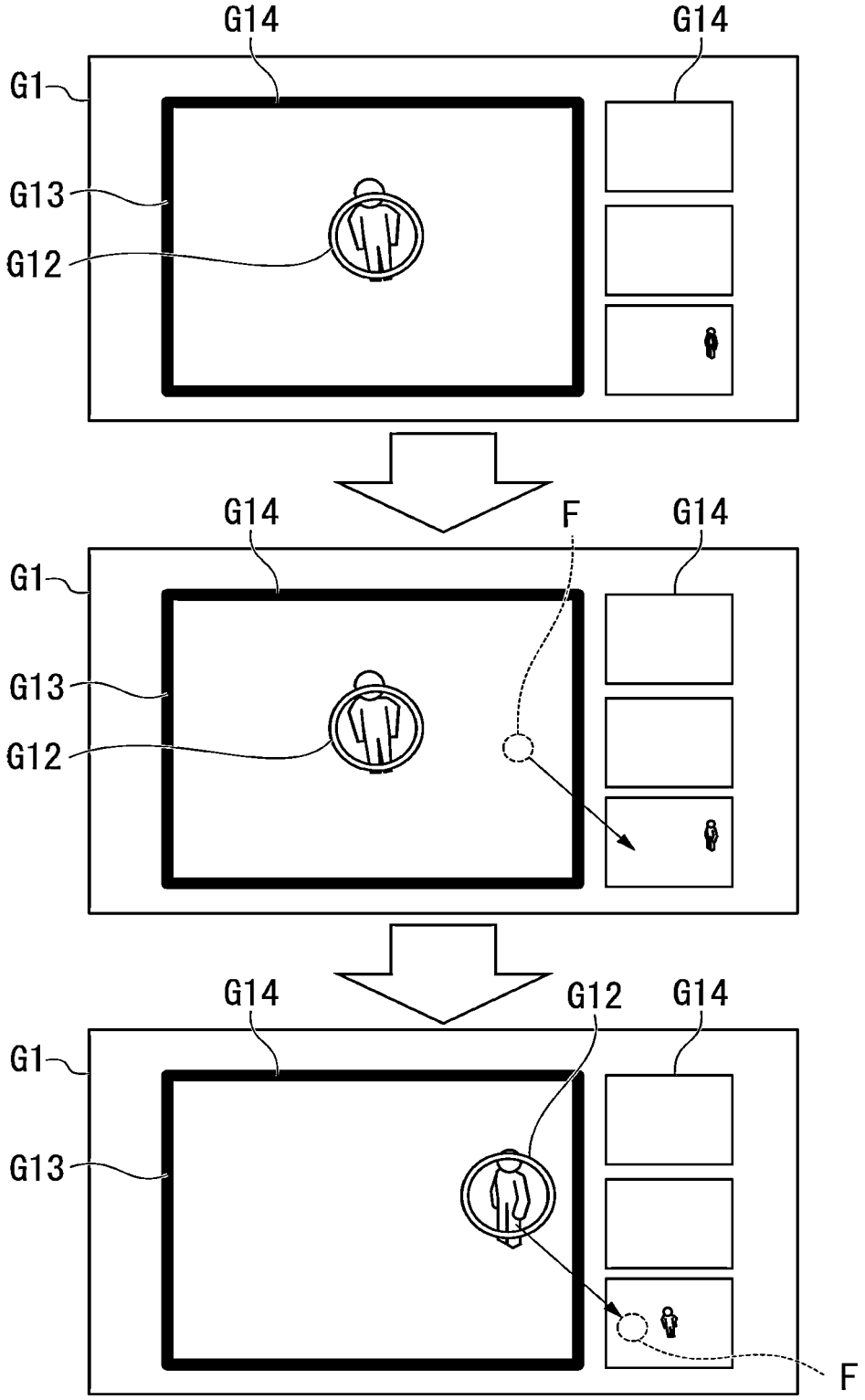
FIG. 8 is a diagram illustrating an operation example of a control device according to a modification example of the first embodiment.

In addition, the control device 145 according to the first embodiment changes the detection range by performing the swipe operation on the overhead view image G11, but is not limited to this. FIG. 8 is a diagram illustrating an operation example of the control device 145 according to a modification example of the first embodiment.

For example, the display screen data G1 according to the first modification example may include a plurality of single camera images G14, as shown in FIG. 8. Then, the single camera image G14 related to the detection range may be displayed larger than the other single camera images G14. In this case, the control device 145 may change the detection range by performing the swipe operation from the single camera image G14 related to the detection range toward another single camera image G14.

Second Embodiment

The control device 145 according to the first embodiment switches the detection range to one between the left rear region Ra, the rear region Rb, the right rear region Rc, and the right front region Rd. On the other hand, the control device 145 according to a second embodiment sets a freely-selected range by the operator as the detection range.

The configuration of the control device 145 according to the second embodiment is the same as that of the first embodiment. The control device 145 according to the second embodiment differs from the first embodiment in the information stored in the detection range storage unit 231 and the operations of the obstacle detection unit 213, the change unit 215, and the display screen generation unit 216.

The detection range storage unit 231 according to the second embodiment stores overhead view range data indicating a shape of the detection range in the overhead view image G11. The shape of the detection range may be represented, for example, by a polygon having a plurality of vertices, or may be a closed area drawn by curved lines. The closed area may be represented by a Bezier curve, for example. The Bezier curve is represented by coordinates of vertices and control points. The overhead view range data is represented by coordinates of a plurality of vertices.

The detection range storage unit 231 also stores image range data indicating the detection range in each captured image. Each image range data indicates a portion appearing in the captured image corresponding to the detection range indicated by the overhead view range data. The image range data is obtained by converting the overhead view range data based on a predetermined correspondence relationship of pixels between the captured image and the overhead view image. That is, it is data obtained by performing inverse transformation of the image transformation by the overhead view image generation unit 212 on the overhead view range data.

The obstacle detection unit 213 according to the second embodiment detects obstacles in each captured image acquired by the acquisition unit 211.

The change unit 215 changes the shape of the detection range stored in the detection range storage unit 231 based on a swipe operation received by the operation input unit 214.

<<About Display Screen>>

Figure 9:
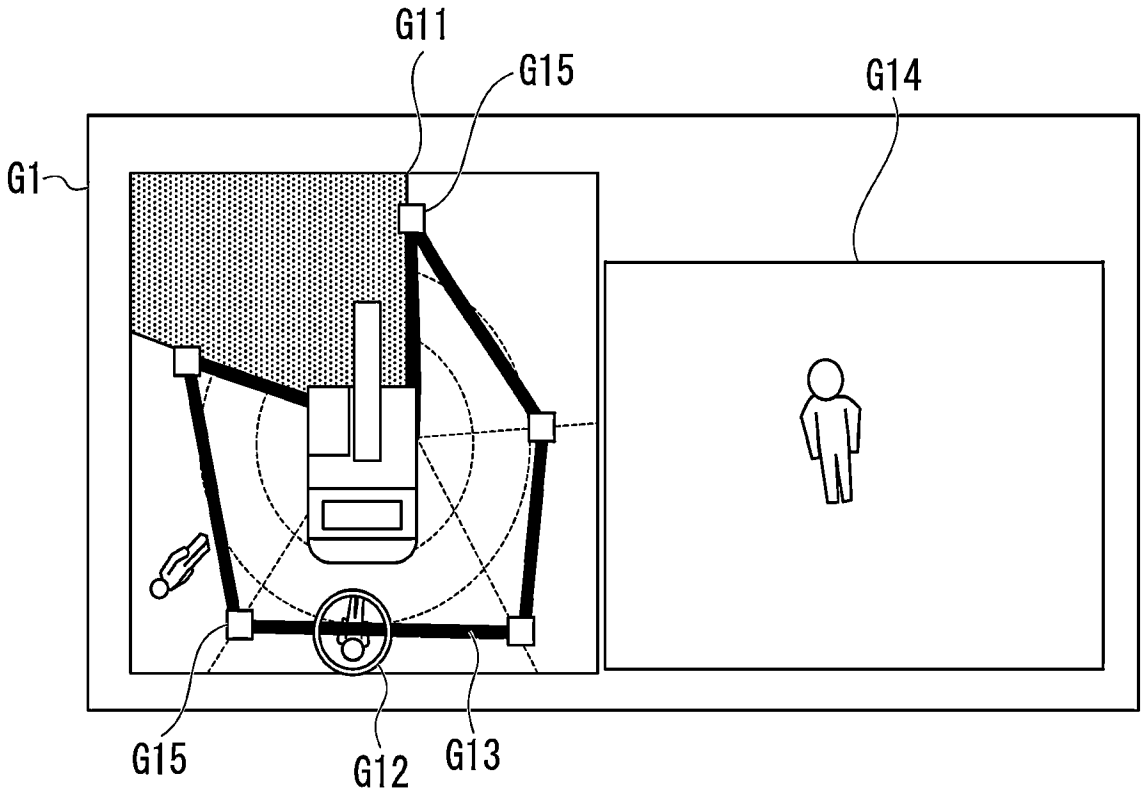
FIG. 9 is a diagram illustrating an example of a display screen related to a second embodiment.

FIG. 9 is a diagram illustrating an example of a display screen according to the second embodiment.

Since the shape of the detection range according to the second embodiment is set in a freely-selected manner by the operator, as shown in FIG. 9, the frame line G13 indicating the shape of the detection range does not necessarily limited to the shape extending along each of the regions Ra to Re. A handle G15 is drawn at each vertex portion of the frame line G13 of the display screen data G1. The operator moves each handle G15 by a swipe operation to change the shape of the frame line G13, that is, the shape of the detection range. In addition, in another embodiment, the frame line G13 or each handle G15 may not be displayed. When each handle G15 is not displayed, the operator changes the shape of the detection range by a swipe operation of the vertex part of the frame line G13. In yet another embodiment, the frame line G13 or each handle G15 may be hidden until touch operation is performed and may be displayed by touch operation.

<<Notification Method of Obstacle>>

Figure 10:
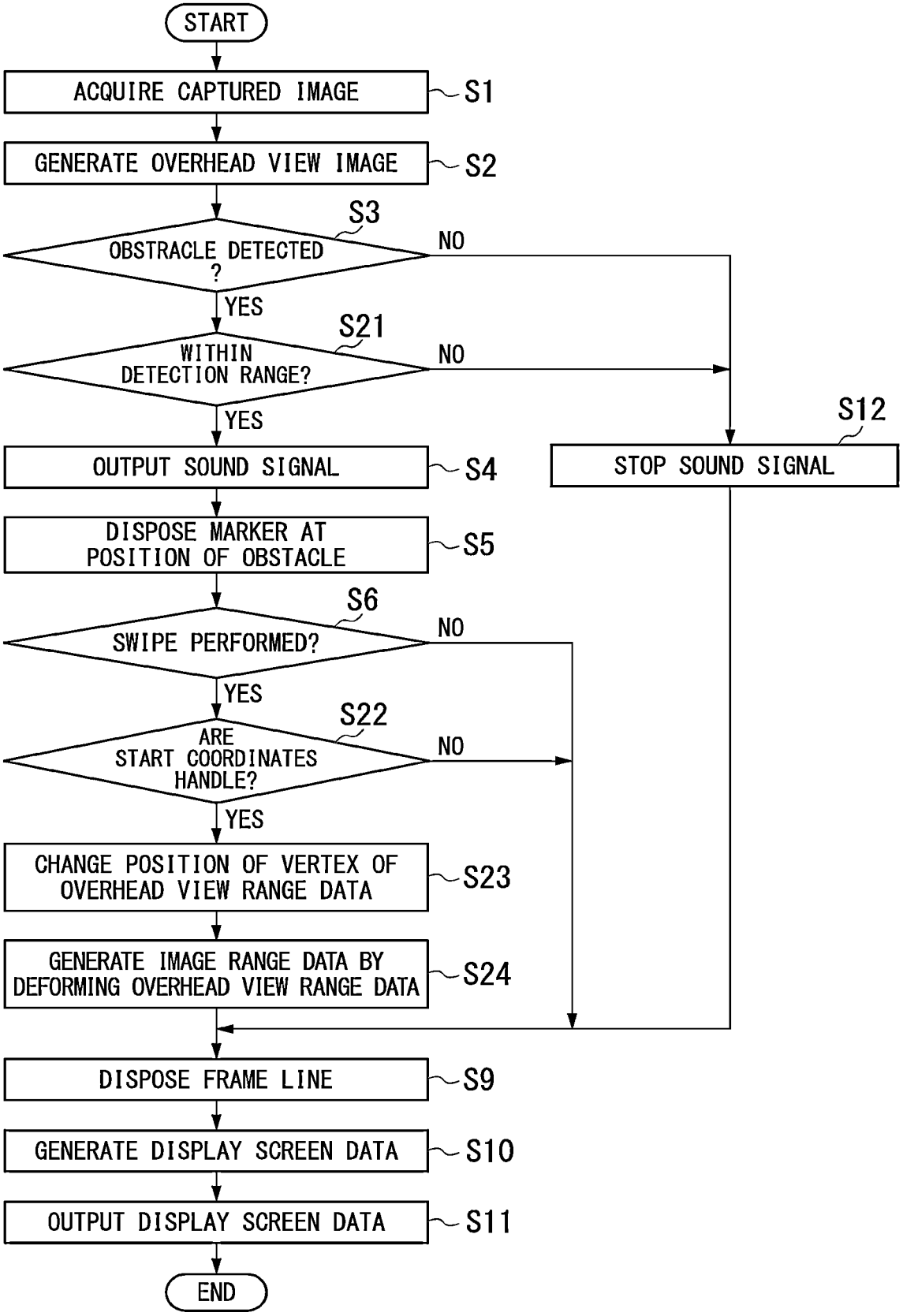
FIG. 10 is a flowchart illustrating an operation of the control device according to the second embodiment.

FIG. 10 is a flowchart illustrating an operation of the control device 145 according to the second embodiment.

When the control device 145 starts periphery monitoring processing, the acquisition unit 211 acquires captured images from the plurality of cameras 121 (step S1). Next, the overhead view image generation unit 212 deforms and combines a plurality of the captured images acquired in the step S1 to generate the overhead view image G11 in which the work machine 100 is centered when a site is planarly viewed from above (step S2). The obstacle detection unit 213 executes an obstacle detection processing for each captured image acquired in the step S1 and determines whether an obstacle is detected (step S3).

When an obstacle is detected in the captured image (step S3: YES), the obstacle detection unit 213 determines whether or not the detected obstacle is within the detection range indicated by the image range data stored in the detection range storage unit 231 (step S21). When the detected position of at least one obstacle is within the detection range (step S21: YES), the alarm control unit 218 outputs an alarm sound signal to the speaker 145S (step S4). Further, the display screen generation unit 216 disposes the marker G12 at a position corresponding to the detected obstacle in the overhead view image G11 generated in step S2 (step S5).

The operation input unit 214 determines whether or not a swipe operation has been performed on the touch panel (step S6). When the swipe operation has been performed (step S6: YES), the change unit 215 determines whether or not the start coordinates of the swipe operation are near the vertex of the overhead view range data stored in the detection range storage unit 231 (step S22). When the start coordinates are not near the vertex of the overhead view range data (step S22: NO), the change unit 215 treats said operation as not a change operation.

When the start coordinates are near the vertex of the overhead view range data (step S22: YES), the change unit 215 changes the position of the vertex near the start coordinates of the swipe operation to the end coordinates of the swipe operation, and rewrites the overhead view range data stored by the detection range storage unit 231 (step S23). Further, the change unit 215 divides the rewritten overhead view range data into regions Ra to Rd and deforms each of them to generate new image range data, and overwrites the image range data stored in the detection range storage unit 231 (step S24).

When the target range is changed in step S24, or when the swipe operation is not performed in step S6 (step S6: NO), or when the start coordinates of the swipe operation are not near the handle (step S22: NO), the display screen generation unit 216 disposes the frame line G13 and the handles G15 indicating the outline of the overhead view range data stored in the detection range storage unit 231 on the overhead view image G11 (step S9). Then, the display screen generation unit 216 generates the display screen data G1 arranging the overhead view image G11 generated in step S2, the marker G12 disposed in step S5, the frame line G13 and the handles G15 disposed in step S9, and the single camera image G14 acquired in step S1 (step S10). The display control unit 217 outputs the generated display screen data G1 to the display 145D (step S11).

When no obstacle is detected in the captured image in step S3 (step S3: NO), the alarm control unit 218 stops outputting the sound signal (step S12). Then, the display screen generation unit 216 disposes the frame line G13 and the handles G15 indicating the outline of the overhead view range data stored in the detection range storage unit 231 on the overhead view image G11 (step S9), and generates the display screen data G1 (Step S10). The display control unit 217 outputs the generated display screen data G1 to the display 145D (step S11).

By repeatedly executing the above processing steps, the control device 145 can change the detection range of obstacle detection into a freely-selected shape in accordance with a change operation by the operator, and can detect the obstacle in the changed detection range.

In addition, the flowchart shown in FIG. 10 is an example, and not all steps need to be executed in other embodiments. For example, in another embodiment, the control device 145 may not perform the processing of steps S4 and S12 when giving notification by an alarm is not performed. Further, for example, in yet another embodiment, the control device 145 may not perform the processing of step S5 when giving notification by the marker G12 is not performed.

Further, in the flowchart shown in FIG. 10, the control device 145 performs obstacle detection processing for the entire range of each captured image in step S3, and then masks objects that are present outside the detection range in step S21; however, in step S3, the obstacle detection processing may be performed only within the detection range. In this case, the control device 145 does not need to perform the determination of step S21.

<<Operation Example>>

An operation example of the control device 145 according to the second embodiment will be described below with reference to the drawings.

Figure 11:
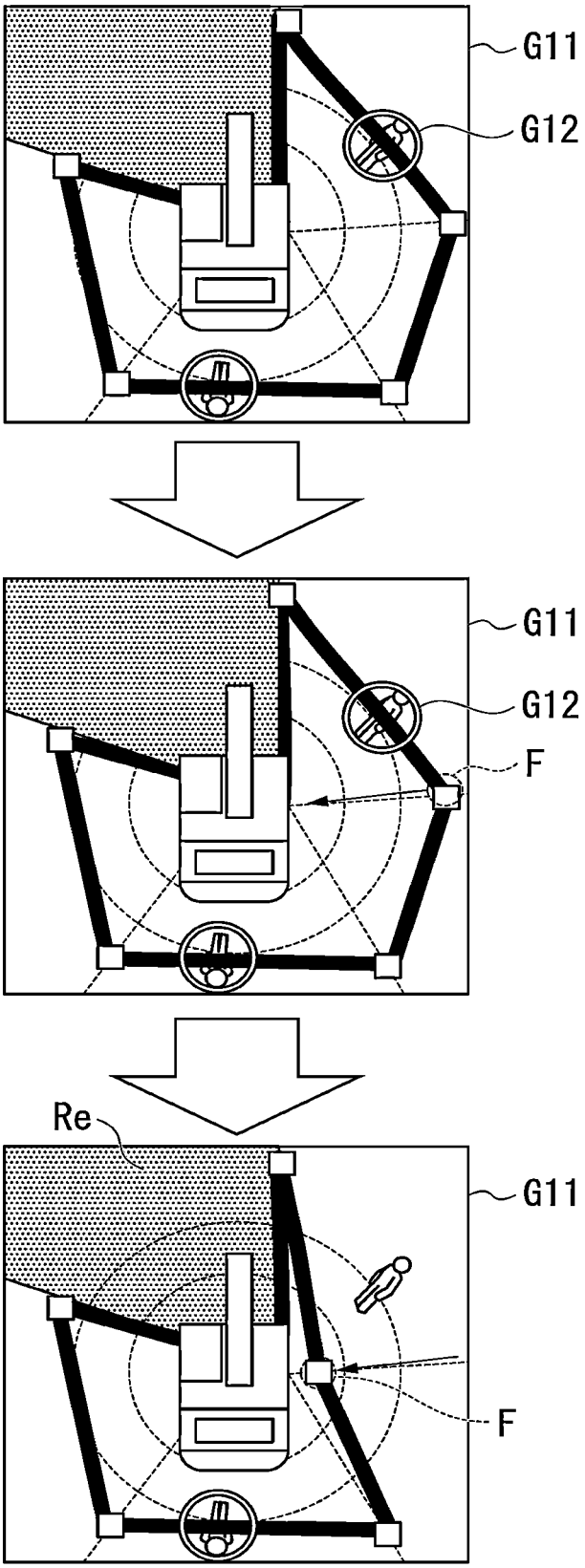
FIG. 11 is a diagram illustrating an operation example of the control device according to the second embodiment.

FIG. 11 is a diagram illustrating an operation example of the control device 145 according to the second embodiment.

When the obstacle detection unit 213 of the control device 145 detects obstacles in the rear region Rb and the right front region Rd in step S3, the obstacle detection unit 213 determines in step S21 whether or not the detected obstacles are within the detection range. Here, the obstacle detection unit 213 determines that the obstacles in both the rear region Rb and the right front region Rd are within the detection range. As a result, the control device 145 puts the marker G12 to each obstacle in the rear region Rb and the right front region Rd.

After that, the operator narrows the detection range of the right rear region Rc and the right front region Rd by a swipe operation. The control device 145 moves the position of the handles G15 according to the swipe operation, and changes the shape of the frame line G13.

After that, when the obstacle detection unit 213 of the control device 145 again detects obstacles in the rear region Rb and the right front region Rd in step S3, the obstacle detection unit 213 determines in step S21 whether the detected obstacles are within the detection range. At this time, the right front region Rd is positioned outside the detection range due to the change in the detection range. Therefore, the control device 145 puts the marker G12 only to the obstacle being present in the rear region Rb.

<<Operation and Effects>>

The control device 145 according to the second embodiment changes the contour shape of the detection range by a swipe operation. That is, the size of the detection range can be changed. A change that increases or decreases the size of the detection range is an example of changing the size of the detection range. The control device 145 determines whether or not to leave the detected obstacle unattended based on the contour shape of the detection range. As the result, it is possible for the operator to intuitively set the detection range for obstacle detection with a high degree of freedom.

Other Embodiments

Although one embodiment has been described in detail above with reference to the drawings, the specific configuration is not limited to the one described above, and various design changes can be made. That is, in another embodiment, the order of the processing steps described above may be changed as appropriate. Also, some processing steps may be executed in parallel.

The control device 145 according to the embodiment described above notifies an obstacle by displaying the marker G12 on the display 145D, displaying an alarm icon G13 on the display 145D, and by an alarm from the speaker 145S; however, other embodiments are not limited to this. For example, the control device 145 according to another embodiment may notify the obstacle by intervention control of the work machine 100.

Also, the work machine 100 according to the embodiment described above is a hydraulic excavator; however, it is not limited to this. For example, the work machine 100 according to another embodiment may be other work machines such as a dump truck, a bulldozer, and a wheel loader.

Also, the control device 145 according to the embodiment described above receives a change operation by a swipe operation; however, it is not limited to this. For example, the control device 145 according to another embodiment may receive a change operation by a tap operation.

Further, the example of the display screen shown in FIG. 5, and the like, describes that boundary lines of the regions of the left rear region Ra, the rear region Rb, the right rear region Rc, the right front region Rd, and the left front region Re are not displayed in the display screen; however, it is not limited to this. The boundary lines of the regions may be displayed on the display screen in another embodiment.

The obstacle detection unit 213 of the control device 145 according to the embodiment described above identifies a region in which an obstacle is present; however, it is not limited to this. For example, the control device 145 according to another embodiment may not identify regions where obstacles are present. In this case, the control device 145 may identify an obstacle closest to contact coordinates based on an enlargement instruction or a type display instruction, and may enlarge the obstacle centering on said obstacle or may display the type of the obstacle in the vicinity of said obstacle.

Also, the control device 145 according to the embodiment described above receives the change operation by the touch operation on the touch panel, such as a swipe operation and a tap operation; however, it is not limited to this. For example, the control device 145 according to another embodiment may provide a hardware key on the display 145D or on the outside of the display 145D, and receive a change operation by operating the hardware key.

<<First Modification Example>>

Figure 12:
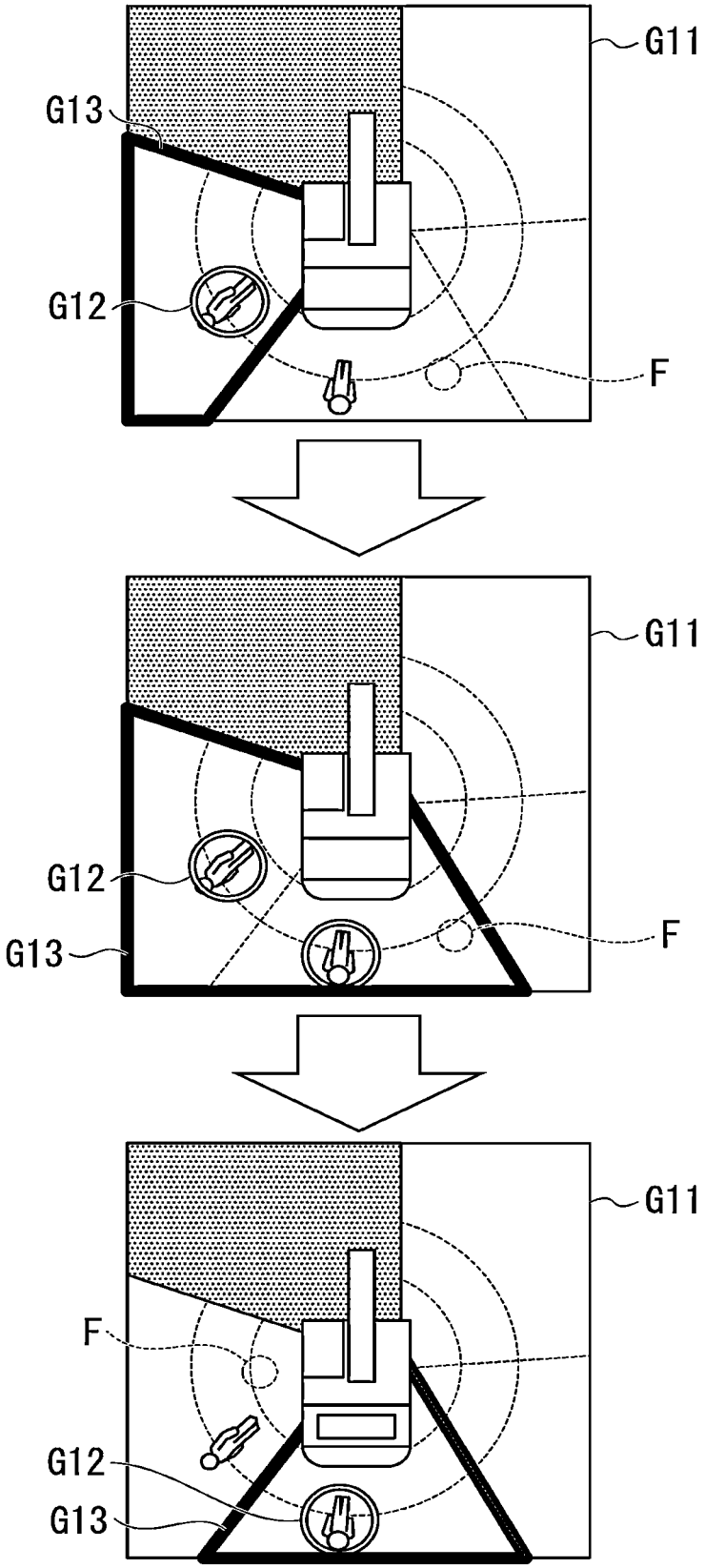
FIG. 12 is a diagram illustrating an operation example of a control device according to the first modification example.

FIG. 12 is a diagram illustrating an operation example of the control device 145 according to the first modification example.

For example, the control device 145 according to another embodiment may switch whether or not to include each of the regions Ra to Rd in the detection range by a touch operation. In this case, the detection range storage unit 231 stores a target flag indicating whether or not the regions are included in the detection range in association with each of the regions Ra to Rd. When the operator taps the overhead view image G11, an ON or OFF state of a value of the target flag associated with the region related to the tapped coordinates is switched. For example, as shown in FIG. 12, when only the left rear region Ra is set as the detection range, when the rear region Rb is tapped, the rear region Rb switches from the non-detection range to the detection range, and the left rear region Ra and the rear region Rb become detection ranges. After that, when the left rear region Ra is tapped, the left rear region Ra switches from the detection range to the non-detection range, and only the rear region Rb becomes the detection range. In this manner, the size of the detection range can be changed by a touch operation on each region.

<<Second Modification Example>>

Figure 13:
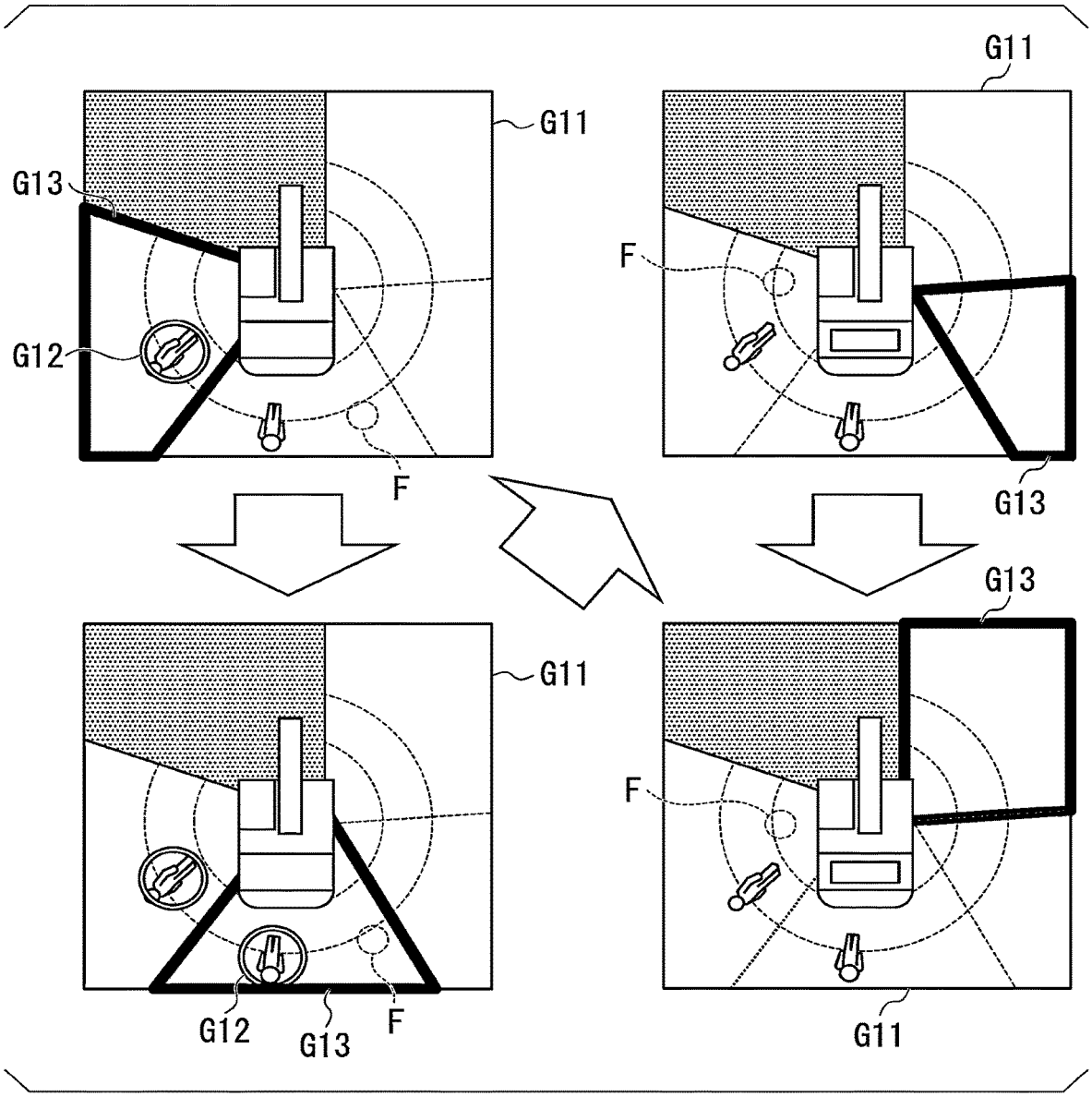
FIG. 13 is a diagram illustrating an operation example of a control device according to a second modification example.

FIG. 13 is a diagram illustrating an operation example of the control device 145 according to the second modification example.

For example, the control device 145 according to another embodiment may switch the detection range in order between the regions Ra to Rd for each touch operation. In this case, the detection range storage unit 231 stores the detection range between the regions Ra to Rd, as the same as in the first embodiment. When the operator taps the overhead view image G11, the control device 145 sets another region adjacent to a region of the current detection range as the detection range. For example, as shown in FIG. 13, the control device 145 may switch the detection range counterclockwise for each tap operation. In this way, the size of the detection range can be changed for each tap operation.

<<Third Modification Example>>

Figure 14:
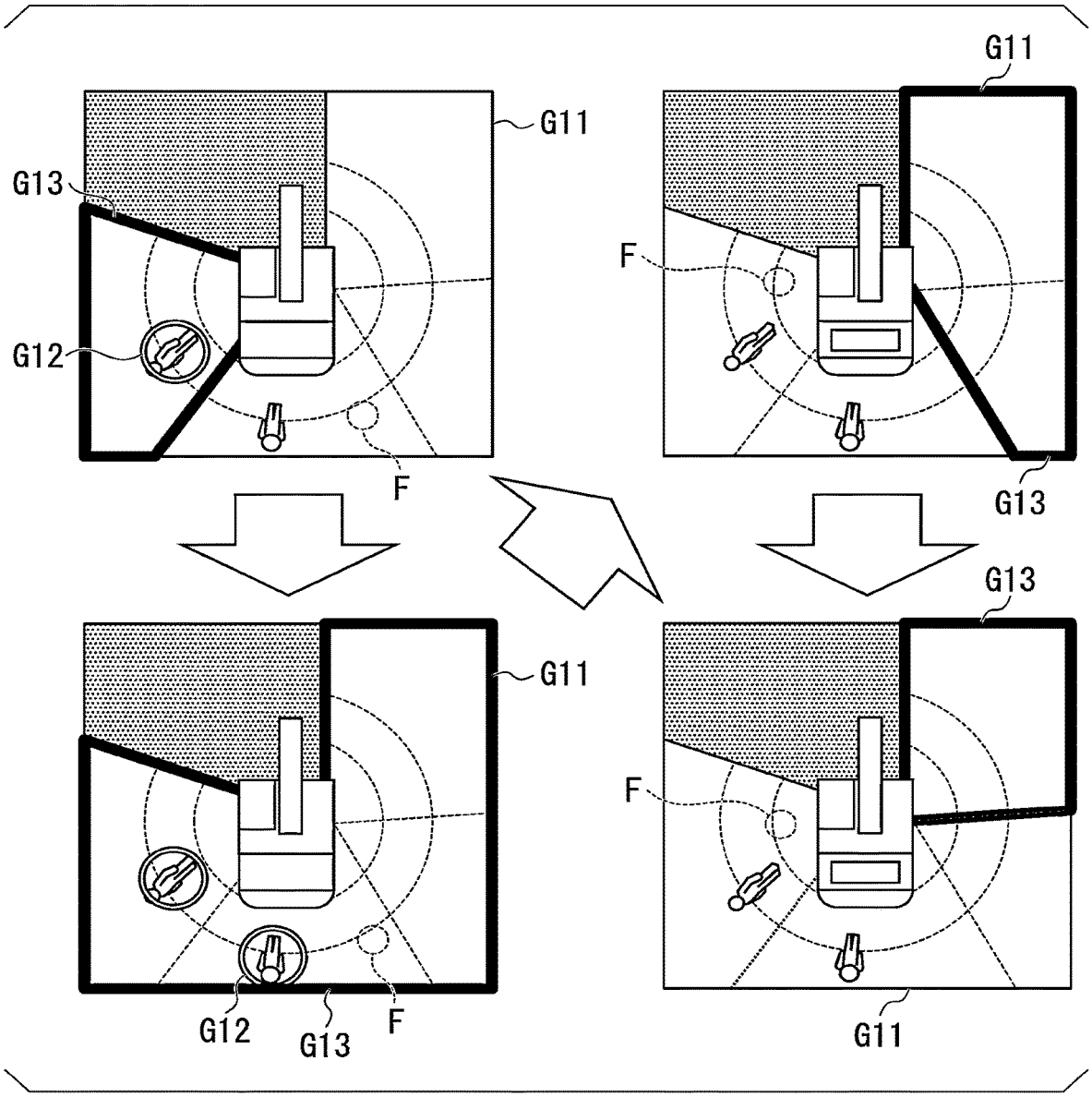
FIG. 14 is a diagram illustrating an operation example of a control device according to a third modification example.

FIG. 14 is a diagram illustrating an operation example of the control device 145 according to the third modification example.

For example, the control device 145 according to another embodiment may set a combination of a plurality of regions in advance as detection range candidates, and switch the detection range among the candidates in order for each touch operation. In the example shown in FIG. 14, as candidates for the size of the detection range, four settings are set such as only the left rear region Ra, a combination of the left rear region Ra, the rear region Rb, the right rear region Rc and the right front region Rd, a combination of the right rear region Rc and the right front region Rd, and only the right front region Rd.

<<Fourth Modification Example>>

Figure 15:
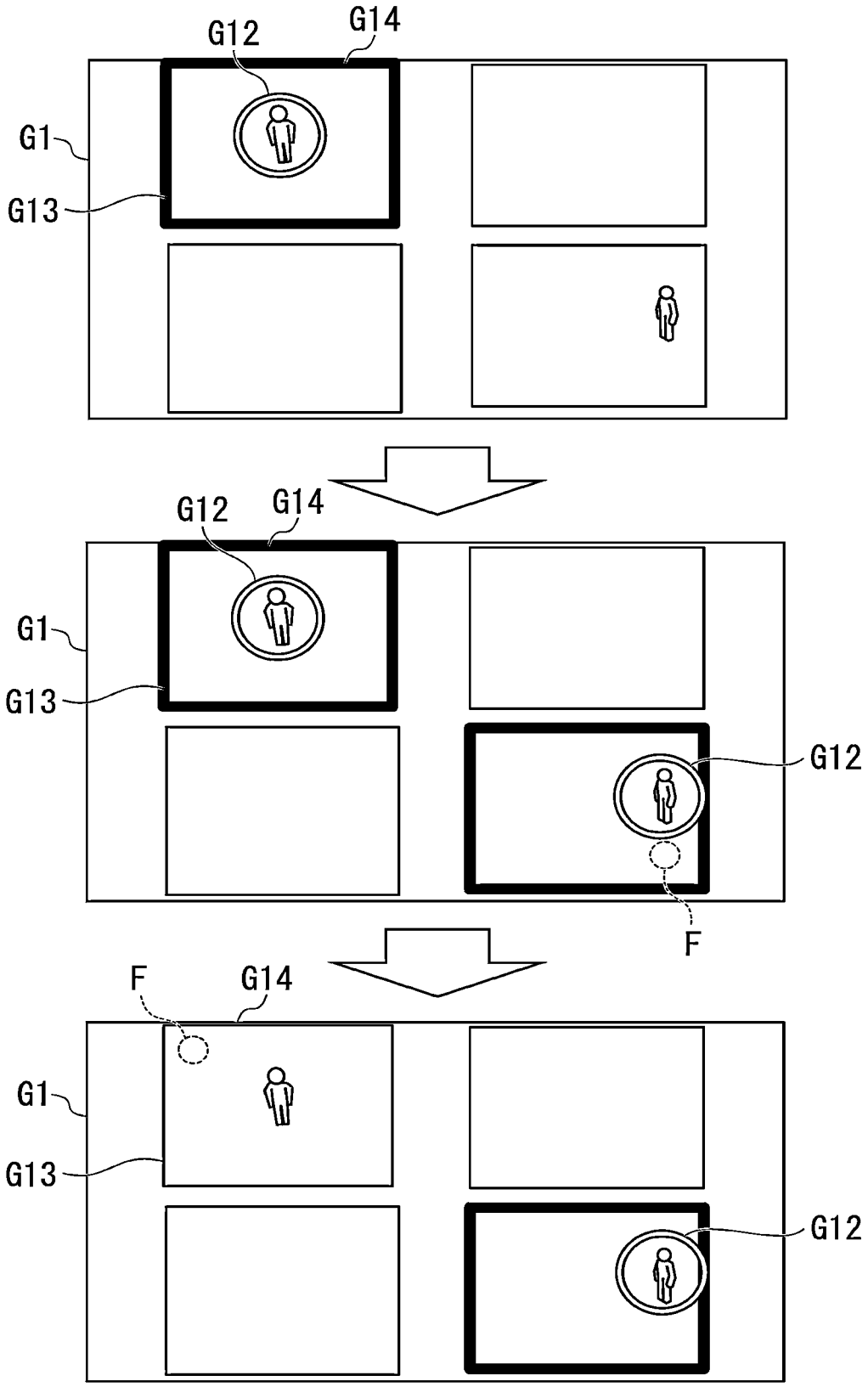
FIG. 15 is a diagram illustrating an operation example of a control device according to a fourth modification example.

FIG. 15 is a diagram illustrating an operation example of the control device 145 according to the fourth modification example.

Further, the first modification example switches whether or not each of the regions Ra to Rd is set as the detection range by a touch operation on the overhead view image G11; however, it is not limited to this. For example, by a tap operation of the single camera image G14, the control device 145 may change the size of the detection range by switching whether or not to use said image as the detection range.

<<Fifth Modification Example>>

Figure 16:
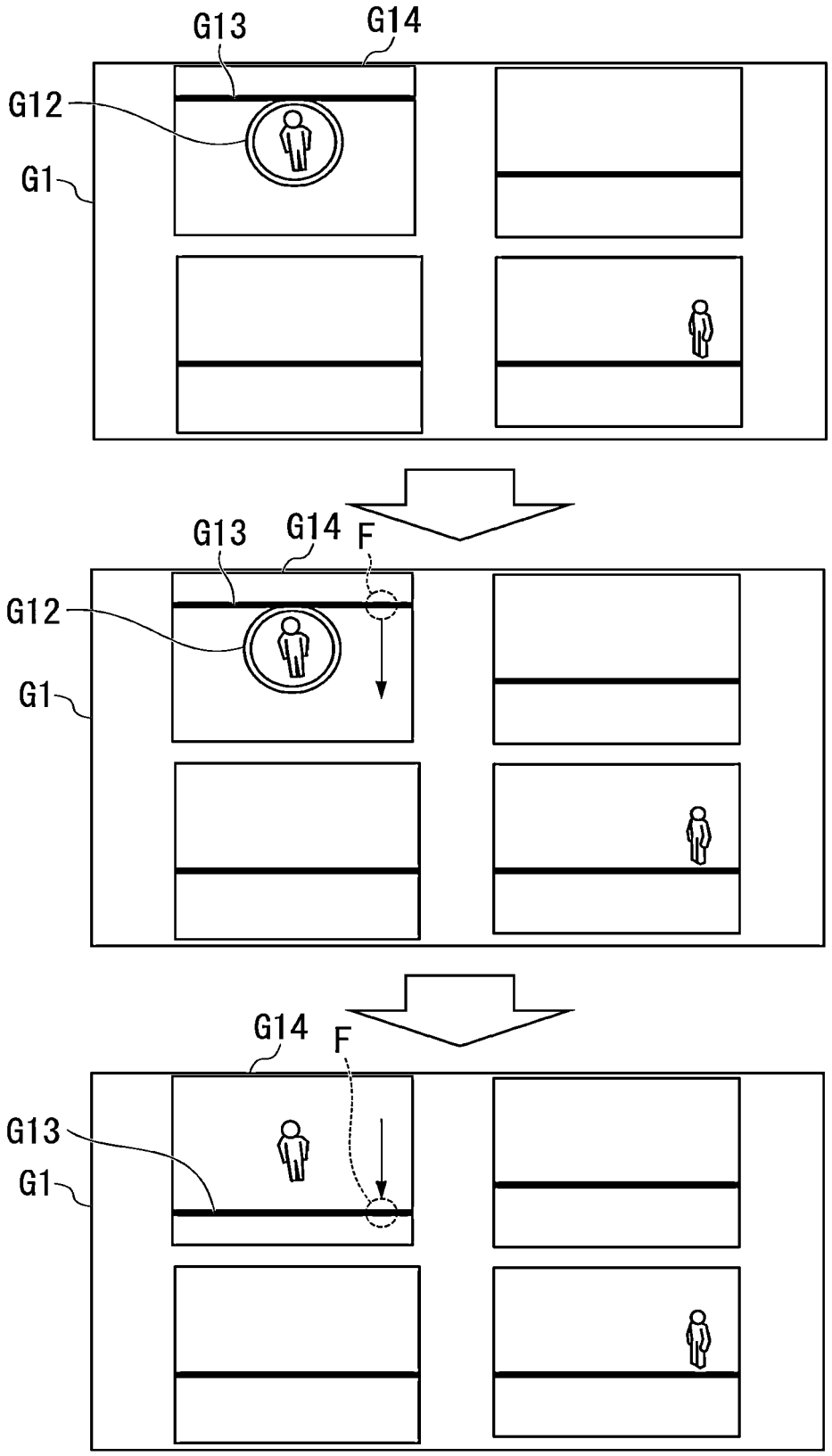
FIG. 16 is a diagram illustrating an operation example of a control device according to a fifth modification example.

FIG. 16 is a diagram illustrating an operation example of the control device 145 according to the fifth modification example.

Also, the second embodiment moves the position of the vertex of the frame line G13 represented in the overhead view image G11 by a touch operation; however, it is not limited to this. For example, the control device 145 may change the size of the detection range of each single camera image G14 by performing a touch operation on the single camera image G14. For example, in the example shown in FIG. 16, the frame line G13 extending in the horizontal direction is displayed on each single camera image G14. The operator can set the detection range of each single camera image G14 by moving the frame line G13 in the vertical direction by a swipe operation. In the example shown in FIG. 14, the mark G12 is displayed when an obstacle is present below the frame line in the single camera image G14. In this case, the detection range storage unit 231 may store a height of the detection range for each single camera image as image range data.

In addition, in the above-described embodiments, the touch operation such as the tap operation described above may be performed with a finger, or may be performed using a touch pen or the like.

INDUSTRIAL APPLICABILITY

According to the above aspect, the operator of the work machine can change the detection range of an obstacle for the work machine.

The invention claimed is:

1. An obstacle notification system for a work machine, comprising:

a processor configured to:

dispose a frame line in a display, the frame line having a predetermined shape and representing a detection range for an obstacle, determine whether the obstacle is within the detection range, give a notification indicating a presence of the obstacle based on determining that the obstacle is present within the detection range, receive an operation on the display for changing the detection range, change a size of the detection range by changing the predetermined shape of the frame line based on the operation on the display, determine whether start coordinates of the operation on the display are in the detection range in which the obstacle is present, based on determining that the start coordinates of the operation on the display are in the detection range in which the obstacle is present, change the size of the detection range based on the operation, and ignore the operation based on determining that the start coordinates of the operation on the display are outside the detection range.

2. The obstacle notification system according to claim 1, wherein changing the size of the detection range is to change a direction of the detection range.

3. The obstacle notification system according to claim 1, wherein changing the size of the detection range is to increase or decrease the size of the detection range.

4. The obstacle notification system according to claim 1, wherein the processor is configured to:

cause a touch panel display to display information indicating the obstacle, and receive a touch operation on the touch panel display.

5. The obstacle notification system according to claim 1, wherein the processor is configured to change the size of the detection range by switching the detection range to one of a plurality of detection range candidates based on the operation.

6. The obstacle notification system according to claim 1, wherein the detection range is determined based on imaging ranges of a plurality of imaging devices that are configured to capture images of a periphery of the work machine, and wherein the processor is configured to:

determine whether the obstacle is present based on image data captured by the plurality of imaging devices, receive an operation of selecting the detection range from the imaging ranges of the plurality of imaging devices, and determine whether to use the selected detection range for a determination of the obstacle.

7. The obstacle notification system according to claim 1, wherein the predetermined shape of the frame line is represented by coordinates of a plurality of vertices, and wherein the operation on the display comprises a swipe operation that comprises moving at least one of the plurality of vertices to thereby change the predetermined shape of the frame line.

8. The obstacle notification system according to claim 7, wherein the frame line includes a handle disposed at each of the plurality of vertices of the frame line, and wherein the swipe operation comprises moving at least one of the handles to thereby change the predetermined shape of the frame line.

9. The obstacle notification system according to claim 1, wherein the processor is configured to dispose an overhead view image showing a periphery of the work machine in the display, the overhead view image including a left rear region, a rear region, a right rear region, a right front region, and a left front region with respect to the work machine, wherein the work machine is disposed at a center position of the overhead view image, and wherein the frame line connects the detection range in the left rear region, the rear region, the right rear region, and the right front region.

10. The obstacle notification system according to claim 9, wherein the frame line is not provided in the left front region of the overhead view image, and wherein the frame line extends from the left rear region and the right front region and connects to the work machine at the center position of the overhead view image.

11. The obstacle notification system according to claim 1, wherein the display is a touch panel display, and the operation comprises a swipe operation that starts from the start coordinates on the touch panel display.

12. An obstacle notification method for a work machine, comprising:

disposing a frame line in a display, the frame line having a predetermined shape and representing a detection range for an obstacle;

determining whether the obstacle is within the detection range;

giving a notification indicating the obstacle based on determining that the obstacle is present within the detection range;

receiving an operation on the display for changing the detection range;

changing a size of the detection range by changing the predetermined shape of the frame line based on the operation on the display;

determining whether start coordinates of the operation on the display are in the detection range in which the obstacle is present;

based on determining that the start coordinates of the operation on the display are in the detection range in which the obstacle is present, change the size of the detection range based on the operation; and ignoring the operation based on determining that the start coordinates of the operation on the display are outside the detection range.

* * * * *